United States Patent [19]

Miller et al.

[11] Patent Number: 4,551,657

[45] Date of Patent: Nov. 5, 1985

[54] FORMAT RECONFIGURABLE CRT DISPLAY

[75] Inventors: Gary Miller, Binghamton; Sam S. Jobes, Vestal; David P. Benfey, Endwell, all of N.Y.

[73] Assignee: General Electric Company, Binghamton, N.Y.

[21] Appl. No.: 329,215

[22] Filed: Dec. 10, 1981

[51] Int. Cl.[4] ..... H01J 29/70; H01J 29/76

[52] U.S. Cl. ..... 315/399; 358/237; 340/727; 315/368

[58] Field of Search ..... 315/399, 368; 358/237; 340/727

[56] References Cited

U.S. PATENT DOCUMENTS 2,287,307 6/1942 Herbst ..... 358/254
3,435,276 3/1969 Sendelweck ..... 315/368
4,183,063 1/1980 Lewis ..... 315/399
4,267,555 5/1981 Boyd et al. ..... 358/254

*Primary Examiner*—Theodore M. Blum
*Attorney, Agent, or Firm*—I. David Blumenfeld

[57] ABSTRACT

A CRT display is provided with a multiple-pole, double-throw switching mechanism, which in conjunction with alternate circuitry provides a means for easily reconfiguring the CRT display presentation. By operating the switches the normal left to right, the top to bottom raster scan may, for example, become a bottom to top, left to right raster scan. When applied to a multicolor CRT display, a second multiple-pole, double-throw switching mechanism serves, upon operation, to redirect beam convergence signals in compliance with the reconfigured format effected by switching the deflection signals.

3 Claims, 3 Drawing Figures

FORMAT RECONFIGURABLE CRT DISPLAY

BACKGROUND OF THE INVENTION

1. Field of the Invention

This invention relates to a CRT display, and more particularly, to such a CRT including means for quickly and easily rotating the format to an alternate configuration.

2. Description of the Prior Art

In the environment of an aircraft cockpit, it may be necessary that a display of the CRT type, in the interest of saving space, be mounted in what might be referred to as the vertical direction; that is, the rectangular-faced CRT is placed on its side. Nevertheless, in such circumstances it would still be desirable to scan the CRT in the horizontal rather than in the vertical direction. There are, furthermore, other occasions when it might be desirable to rotate the format of a CRT display so that it may be scanned from top to bottom or bottom to top or right to left, for example. There has, however, been no way of accomplishing such format reconfiguration without either major wiring changes or making internal mechanical changes. This problem has been complicated by the fact that the deflection system of a typical CRT display has output channels of different performance characteristics. In a display having the capability of both raster scanning and stroking, and the hybrid thereof, one channel provides fast slewing rates while the other has relatively slow slewing rates. And, of course, further complicating the problem, in the case of a multicolor shadow-mask CRT, is the use of dynamic convergence correction, the functions of which are channel-dependent. The prior art has not produced a solution to the problem.

Consequently a need exists for a CRT display having means for quickly and easily reconfiguring the display format.

It is, therefore, an object of the present invention to provide a format reconfigurable CRT display.

It is a further object of the present invention to provide a CRT display having means for quickly and easily effecting reconfiguration of the display format.

It is a still further object of the present invention to provide such a format reconfigurable CRT display without the necessity of making major wiring or internal mechanical changes each time a reconfigured format is desired.

Other objects and advantages of the present invention will become apparent as the description thereof proceeds.

SUMMARY OF THE INVENTION

In accordance with the present invention, there is provided an electronic display including a CRT having at least one electron beam. Deflection means are included for receiving deflection signals from a deflection circuit for effecting deflection of the electron beam. Means are provided for redirecting the deflection signals to effect reconfiguration of the display presentation.

In another aspect of the invention, the CRT is of the multi-electron beam type and is further provided with convergence means for receiving electrical correction signals from convergence circuitry for effecting convergence of the electron beams at the CRT screen. Also included are means for redirecting the correction signals to provide convergence of the electron beams in accordance with the reconfigured presentation.

DESCRIPTION OF THE PREFERRED EMBODIMENT

Figure 1:
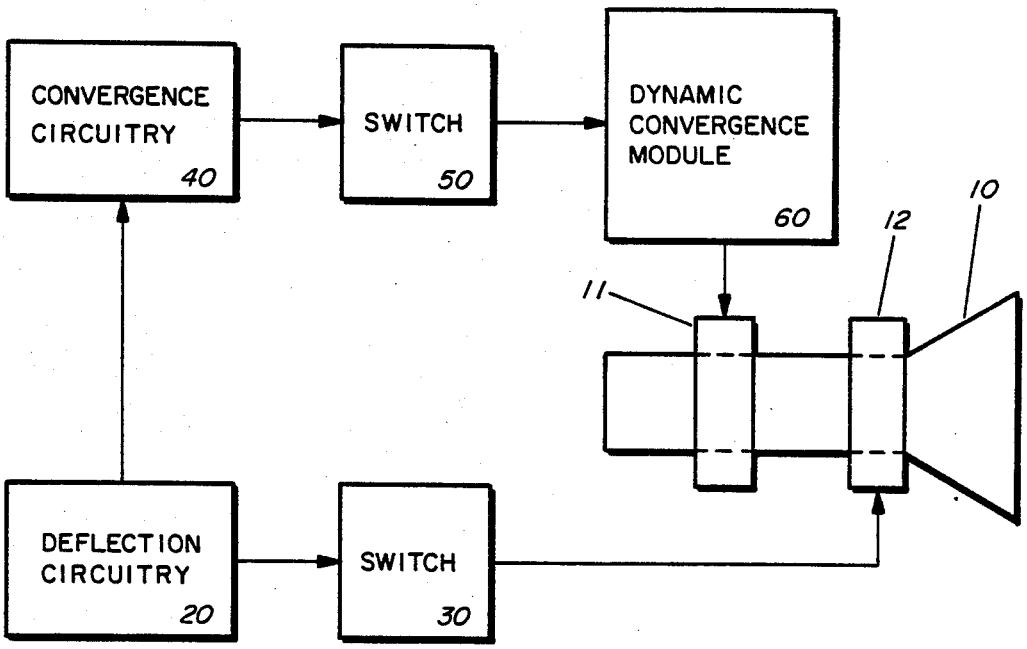
FIG. 1 shows in block diagram form the preferred embodiment of a circuit useful in the format reconfigurable CRT display of the present invention.

In accordance with the present invention, and referring now to FIG. 1 of the drawing, there is shown in block diagram form the preferred embodiment of the format reconfigurable CRT display of the present invention. A cathode ray rube (CRT) 10 having at least one electron beam is provided as are deflection means including a deflection yoke 12 mounted upon the neck of the CRT for receiving deflection signals from deflection circuit 20 for effecting deflection of the at least one electron beam. Means are provided in the form of switching mechanism 30 for redirecting the deflection signals to effect reconfiguration of the display presentation.

In a situation wherein the CRT is of the multi-electron beam type, there is further provided convergence means including a plurality of convergence coils 11 also mounted upon the neck of CRT 10 for receiving electrical correction signals from convergence circuitry 40 for effecting convergence of the electron beams at the CRT screen. Also included are means including switching mechanism 50 for redirecting the correction signals to provide convergence of the electron beams in accordance with the reconfigured presentation. A dynamic convergence module 60 is provided for the purpose of accepting the redirected correction signals from the switching mechanism 50 and providing suitable output signals to drive the beam convergence coil assembly 11.

Figure 2:
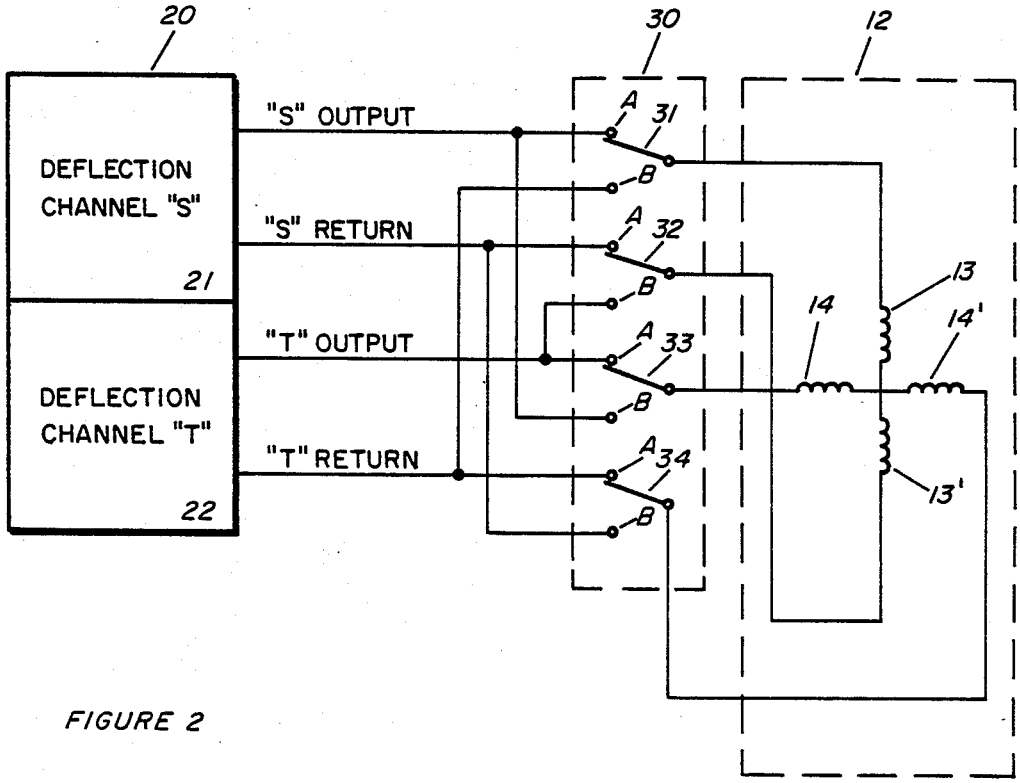
FIG. 2 shows, by schematic representation, the details of the reconfigurable deflection circuitry of the preferred embodiment of FIG. 1.

Referring now to FIG. 2, there is shown in more detail those portions of the circuit of FIG. 1 which relate to the redirection, switching, of the deflection signals which emanate from the deflection circuit 20 and which are supplied to the deflection yoke 12. As can be seen, the redirecting means, switching mechanism 30, includes a plurality of single-pole, double-throw switches arranged in circuit with the deflection means and the deflection circuit 20. These switches may be of the ganged mechanical type and serve to redirect the signals coming from the two deflection channels S and T to the coils of the deflection yoke.

Asssuming that channel S is the normal horizontal deflection channel and it provides deflection signals to what are normally the horizontal coils 13 and 13', and assuming that channel T is the normal vertical deflection and its deflection signals are provided to coils 14 and 14', then such deflection signals will be provided through the switch mechanism 30 as shown in FIG. 2. Should it be desired, however, that the display presentation format be rotated, as for example 90 degrees, then switches 31, 32, 33, and 34 can be rotated from contact with the A position to the B position, thereby to reconfigure the circuit.

Figure 3:
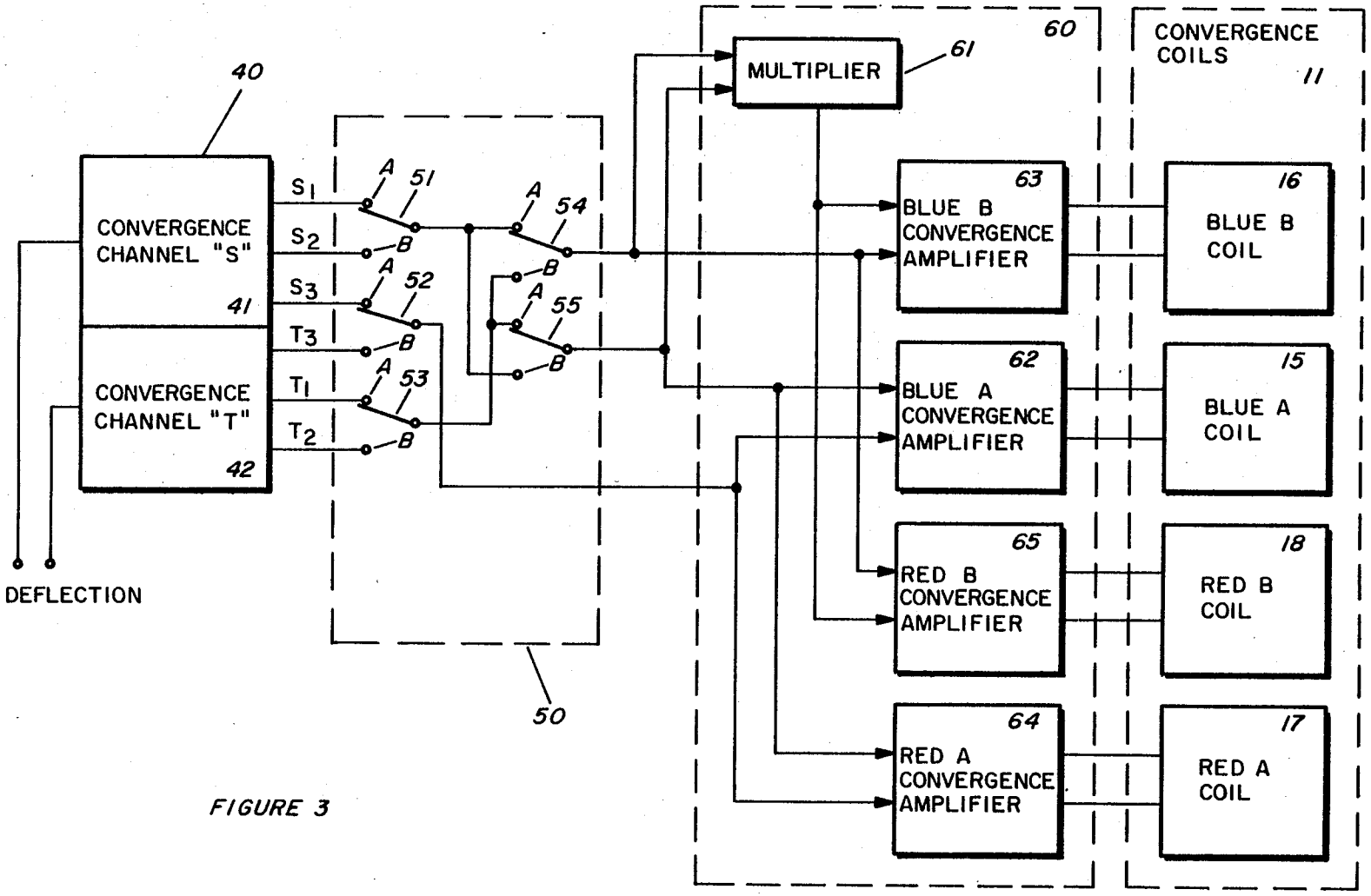
FIG. 3 shows in schematic and block diagram form details of the convergence signal redirecting format of the preferred embodiment of FIG. 1.

Referring to FIG. 3, there is shown in more detail the convergence related circuitry of FIG. 1. Assuming that the CRT 10 is of the three-beam, inline color type in which the green beam is considered the reference beam, then the convergence coil assembly 11 includes a blue convergence A coil 15 and a blue convergence B coil 16, a red convergence A coil 17 and a red convergence B coil 18. The convergence circuitry 40 which has inputs from the deflection circuit 20 as shown in FIG. 1, includes two channels: S convergence channel 41 and T convergence channel 42. S convergence channel 41 provides three output signals S1, S2, and S3 and T convergence channel 42 provides likewise three output signals, T1, T2, and T3. Switch mechanism 50 includes a plurality of switches 51, 52, 53, 54, and 55. Switches 51, 52, and 53 are of the single-pole, double-throw type and are arranged to receive convergence signals from the convergence channels 41 and 42. As determined by the specific state of arrangement of switches 51, 52, 53, 54, and 55, three of the six input convergence correction signals (S1, S2, S3, T1, T2, T3) are selected and applied to the convergence amplifier, dynamic convergence module 60.

Dynamic convergence module 60 receives the redirected signals coming from the switch mechanism 50 and, through the operation of analog multiplier 61 and convergence amplifiers 62, 63, 64, and 65, provides suitable output drive signals to excite the four beam convergence coils. Two of the redirected signals from switch 51 are received by analog multiplier 61 which provides an output signal which is a product of the inputs. This output signal, together with the redirected signals from switch 50, are then applied (in accordance with the required mathematical form for beam misconvergence correction) to the four convergence amplifiers—blue A, blue B, red A, red B.

Blue B convergence amplifier combines its two respective input signals and, through active drive techniques, provides a proportional current in its associated beam convergence coil. (Blue B). Convergence amplifiers 62, 65, and 64 function in a similar manner as just described.

A brief description of the operation of the switches 30 and 50 will now be given. Referring to FIG. 2, switch 30 redirects the output signals from deflection channels "S" and "T" to the magnetic deflection yoke 12 which is of the single ended form. Coils 13 and 13' constitute a beam position mechanism for one axis of CRT deflection. Coils 14 and 14' similarly constitute a beam positioning mechanism for the other axis of CRT deflection.

The "S" OUTPUT is routed through switch 31 to one side of deflection coil 13. The current thus produced by action of this "S" OUTPUT drive signal flows through coil 13' and is returned to deflection channel "S" through switch 32. Similarly, the "T" OUTPUT drive signal, applied to coil 14 through switch 33, produces a resulting current which flows through coil 14' and is returned to deflection channel "T" through switch 34.

Referring to FIG. 3, switch 50 consists of five individual switches of the single-pole, double-throw type—51, 52, 53, 54, and 55. With the switches arranged as shown, the switches collectively redirect the six input signals from convergence channels "S" and "T" into three output signals which provide the correction terms required to converge the three beams of the color CRT. As can be seen, input signal $S_1$ is routed through switches 51 and 54 to form one of the output signals.

Similarly, signal $S_3$ is selected by switch 52 and appears as the second output correction signal. Finally, input signal T1 is routed through the contacts of switches 53 and 55 to provide the third output correction signal. In general, depending on the specific arrangement of switches 51, 52, 53, and 55, any three of the six input signals can be redirected to the output signal lines from switch 50. The exact arrangement of the selected output signals is dependent on the requirement of the mathematical equations used to converge the beams of the CRT.

The description and figures herein apply specifically to a three-electron beam, in-line color CRT of the shadow-mask type; however, the invention will apply equally as well to a single-gun monochrome CRT, to the penetration type of color tube, to the delta gun color CRT as well as to other multiple gun and/or multiple beam color CRTs. It is within the contemplation of the invention that a display format may be reconfigured in a multitude of ways over and above those described herein. For example, the horizontal scan lines may proceed from right to left of the viewed screen as opposed to the typical left to right for the horizontal scan lines. And of course one may scan from right to left but the vertical movement may be from bottom to top; such is also within the contemplation of the present invention. In short, the switching technique described can be expanded to provide any orientation of the displayed picture with respect to the display mounting. Likewise, alternate forms of switching may be utilized such as, for example, electrically driven relays and electronic switches in addition to the mechanical type described and shown herein.

While a format reconfigurable CRT display has been described in what is presently considered to be a preferred embodiment of the invention, it will be apparent to those skilled in the art that various changes and modifications other than those discussed above may be made in the structure and in the instrumentalities utilized without departing from the true spirit and scope of the invention.

We claim:

1. In an electronic display including a CRT having at least one electron beam and beam deflection means including horizontal and vertical deflection means for deflecting said electron beam in orthogonal directions;

(a) means for generating horizontal and vertical deflection signals, the slew rates of said horizontal signal being greater than that of said vertical deflection signal;

(b) means for coupling the horizontal signal to the horizontal deflection means and the vertical signal to the vertical deflection means;

(c) means for maintaining the display format in the same spatial orientation with a change in physical orientation of the CRT and its deflection means, or to reorient the spatial display format without changing the physical orientation of the CRT, including;

(d) means for switching signals between the horizontal and vertical deflection means to maintain the different sweep rates aligned along the same spatial orthogonal axes even though the physical orientation of the CRT and the deflection means has been changed.

2. The display according to claim 1 including means for selectively reversing the polarity of at least one of the deflection signals concurrently with their interchange to change the display orientation independently of the physical orientation of the CRT.

3. The display according to claim 1 wherein the CRT contains a plurality of electron beams, and means associated with the CRT for receiving electrical correction signals to converge said electron beams at the CRT screen further including means for interchanging the correction signals between the deflection means concurrently with the interchange of the beam deflection signals between the defection means.

* * * * *